US005229942A

United States Patent [19]

Nicholson et al.

[11] Patent Number: 5,229,942

[45] Date of Patent: Jul. 20, 1993

[54] CONTROL SYSTEM FOR REMOTE POWER UP

[75] Inventors: William D. Nicholson, Waukesha; Thomas M. Fudali, Delafield; Ronald V. Sova, Milwaukee; Allan J. Renner, New Berlin; Robert T. Braun, Milwaukee; Bernadine M. Palczynski, New Berlin; Timothy Ledger, Elkhorn; Jim Visser, Pewaukee; John C. Pendell, West Allis; Michael J. Brown, Milwaukee, all of Wis.

[73] Assignee: Bear Automotive Service Equipment Company, New Berlin, Wis.

[21] Appl. No.: 612,320

[22] Filed: Nov. 13, 1990

[51] Int. Cl.[5] ..... G06F 15/20

[52] U.S. Cl. ..... 364/424.03; 364/551.01; 365/227; 379/106

[58] Field of Search ..... 364/424.04, 424.01, 364/464.04, 424.03, 273.1, 273.2, 273.5, 948.4, 948.6, 551.01; 379/106, 107; 340/825.08; 365/227

[56] References Cited

U.S. PATENT DOCUMENTS

| | | | |
|---|---|---|---|
| 4,404,639 | 9/1983 | McGuire et al. | 364/424.04 |
| 4,431,134 | 2/1984 | Hendricks et al. | 236/46 R |
| 4,654,869 | 3/1987 | Smith et al. | 379/107 |
| 4,757,463 | 7/1988 | Ballou et al. | 364/424.04 |
| 4,864,603 | 9/1989 | Battmann et al. | 379/106 |
| 5,003,476 | 3/1991 | Abe | 364/424.03 |
| 5,003,477 | 3/1991 | Abe et al. | 364/424.03 |
| 5,010,568 | 4/1991 | Merriam et al. | 379/107 |
| 5,056,023 | 10/1991 | Abe | 364/424.03 |
| 5,081,586 | 1/1992 | Barthel et al. | 364/424.05 |

*Primary Examiner*—Thomas G. Black
*Assistant Examiner*—Collin W. Park

[57] ABSTRACT

Automotive vehicle test equipment includes a controller which controls power supplied to a test circuit. The controller monitors a sleep mode switch which determines whether the controller enters a sleep mode. In sleep mode, the controller disconnects the test circuit from a power source. The controller also monitors a telephone line. Upon detection of a ring signal on the telephone line, the controller connects the test circuit to the power supply.

9 Claims, 2 Drawing Sheets

CONTROL SYSTEM FOR REMOTE POWER UP

BACKGROUND OF THE INVENTION

The present invention relates to automotive vehicle test equipment. In particular, the invention relates to a controller for an automotive vehicle test system.

Automotive vehicle test equipment is used to measure various parameters which relate to automotive vehicles. For example, automotive vehicle test equipment can test parameters such as vehicle exhaust emissions, wheel alignment or engine operation.

In some situations, the automotive vehicle test equipment must be capable of being interrogated from a remote site. This is typically done using telephone communications. Many states now require automotive vehicle certification of exhaust gas emissions. Automotive vehicles are tested at remote locations throughout the day and test results and owner information are stored in the automotive vehicle test system. Subsequently, the stored information is transferred to a central location for review by the appropriate state officials. Typically, this transfer process takes place during off hours when telephone rates are less and when the test equipment is not in use to test automotive vehicles.

The automotive vehicle test equipment must constantly monitor a telephone line for receipt of an interrogation signal from the central location. If the equipment is turned off by an operator, the automotive vehicle test system will be unable to respond to the interrogation request when it is received over the telephone line.

If the automotive vehicle test equipment is continually left turned on, the system will waste power and the lifespan of the components in the system will be significantly reduced. One possible solution is to provide only a brief time window during which an interrogation command from the central site may be received. This is both inconvenient and impractical. This technique requires an operator to insure that the system is turned on at the beginning of the time window and subsequently turned off, after the end of the time window. Furthermore, if the central location is delayed in sending the interrogation request to the automotive vehicle test equipment, the time window will pass by and it will be impossible for the central location to collect stored information from the automotive vehicle test system.

SUMMARY OF THE INVENTION

The present invention provides an automotive vehicle test system which stores vehicle test information and may be interrogated from a remote, central location.

In the present invention, automotive vehicle test circuitry tests parameters of automobiles. Test results are stored in the test circuitry along with information which relates to the owner of the vehicle. Typically, the test parameters relate to automotive vehicle exhaust emissions. A control circuit is coupled to the test circuit and controls electrical power supplied to the test circuit. During testing, the control circuit supplies power to the test circuit When testing is completed, typically at the end of the day, the control circuit is instructed to enter a "standby mode" or "sleep mode." In the sleep mode, the control circuit disconnects the test circuit from a power source. The control circuit also includes a telephone connection. When the control circuit is in sleep mode and a ring signal is detected on the telephone input, the control circuit connects the power source to the test circuit and interrogation requests may then be received over the telephone connection and stored test results transmitted to the remote, central location.

Using the present invention, the power used by the test circuit is reduced because the test circuit is powered up only when required. Furthermore, since the test circuit is turned on and not in use, the lifespan of components in the test circuit is increased. This improves the overall reliability of the automotive vehicle test equipment.

DETAILED DESCRIPTION OF THE PREFERRED EMBODIMENTS

Figure 1:
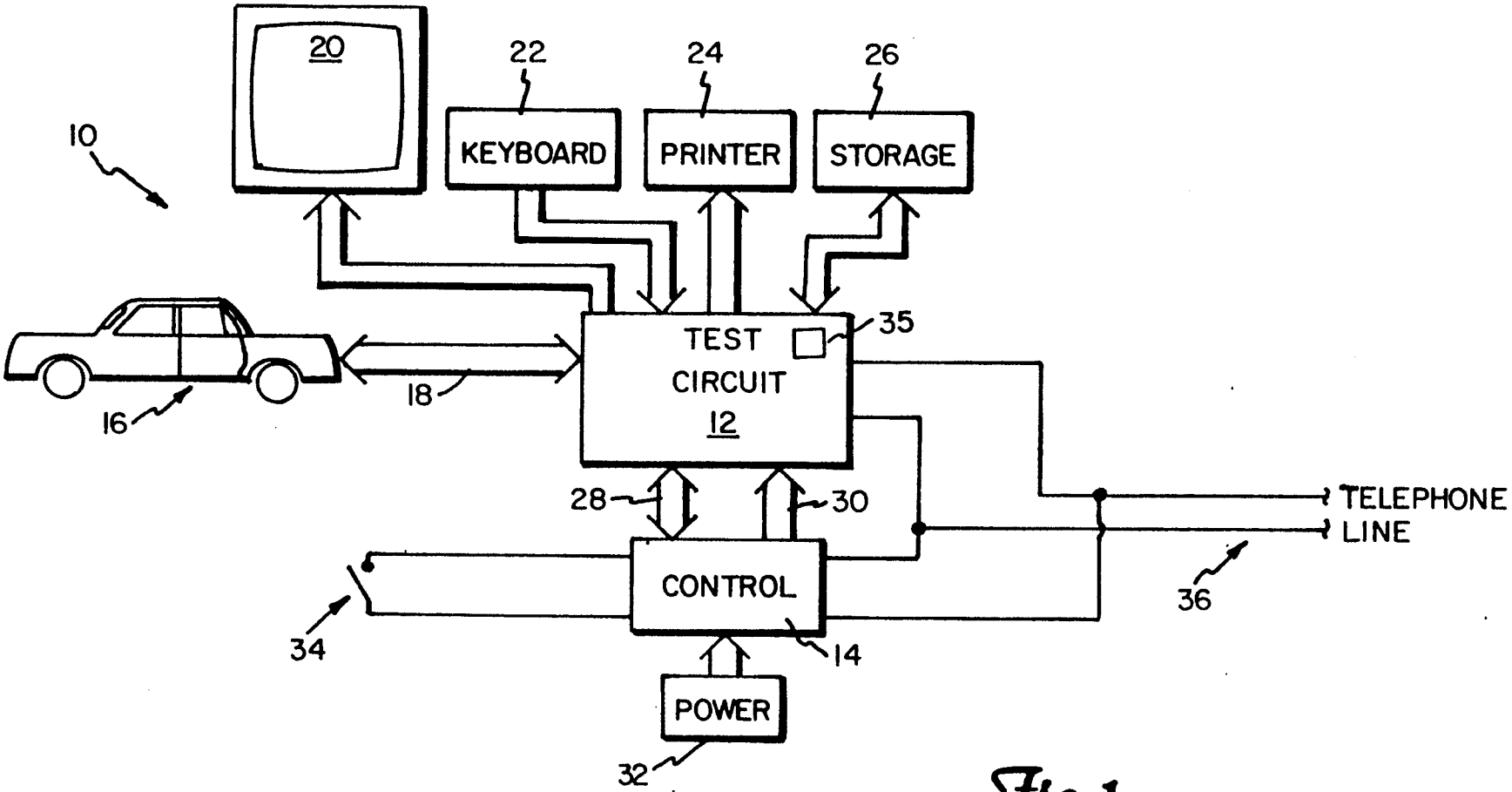
FIG. 1 is a block diagram of automotive vehicle test equipment in accordance with the present invention.

FIG. 1 is a block diagram of an automotive vehicle test system 10 made in accordance with the present invention. Automotive vehicle test system 10 includes test circuit 12 and control circuit 14. Test circuit 12 connects to an automotive vehicle 16 via a communication link 18. Test circuit 12 connects to display 20, keyboard 22, printer 24 and storage device 26. Test circuit 12 also supplies power to display 20, keyboard 22, printer 24 and storage device 26.

Control circuit 14 connects to test circuit 12 through data link 28 and power connection 30. Control circuit 14 also connects to a power supply 32 and a switch 34. Test circuit 12 and control circuit 14 are connected to a telephone line 36. Test circuit 12 includes a modem 35 for communicating over telephone line 36.

In operation, test circuit 12 performs tests such as, for example, exhaust analysis upon automotive vehicle 16 Communication link 18 transfers information between test circuit 12 and sensors (37A, 37B and 37C shown in FIG. 2) which connect to automotive vehicle 16. Sensors 37A, 37B and 37C may be independent from automotive vehicle 16 and connected to vehicle 16 by an operator, or sensors 37A, 37B and 37C may be part of vehicle 16 so that test circuit 12 merely plugs into a communicating system of vehicle 16. An operator controls test circuit 12 through keyboard 22. The operator identifies the model, year and owner of automotive vehicle 16 to test circuit 12 through keyboard 22. Test circuit 12 displays instructions and the test results on display 20. Certificates which indicate automotive vehicle 16 has passed certain performance tests may be printed on printer 24. Test results are stored in storage system 26. Storage system 26 typically comprises a magnetic disk storage system.

Test circuit 12 receives power from power supply 32 through control circuit 14 and power connection 30. Information is passed between test circuit 12 and control circuit 14 through data link 28. Switch 34 provides an input to control circuit 14. The position of switch 34 determines whether or not control circuit 14 enters a "standby mode" or "sleep mode." In the sleep mode, control circuit 14 disconnects test circuit 12 from power supply 32 and power is not provided to test circuit 12 over power connection 30. Similarly, test circuit 12 does not supply power to display 20, keyboard 22, printer 24 and storage device 26. Typically, an operator places control circuit 14 into sleep mode at the end of the day, after testing of automotive vehicles has been completed.

Both test circuit 12 and control circuit 14 are connected to telephone line 36. Control circuit 14 continually monitors telephone line 36. If a ring signal is detected on telephone line 36 by control circuit 14 when control circuit 14 is in the sleep mode, control circuit 14 provides power to test circuit 12 from power supply 32 through power connection 30. After test circuit 12 has been powered up by control circuit 14, test circuit 12 monitors telephone line 36 for interrogation commands. Test circuit 12 includes a modem (not shown) for receipt of interrogation commands. Control circuit 14 informs test circuit 12 over data link 28 that a ring signal has been detected on phone line 36. Upon receipt of correct interrogation commands from telephone line 36, test circuit 12 transmits information over telephone line 36 from storage system 26. Typically, the interrogation requests comes from a centralized location in which test results are collected from remote sites scattered across a state. After test circuit 12 has transmitted the information stored in storage system 26 over telephone line 36, control circuit 14 returns to the sleep mode and disconnects test circuit 12 from power supply 32.

Figure 2:
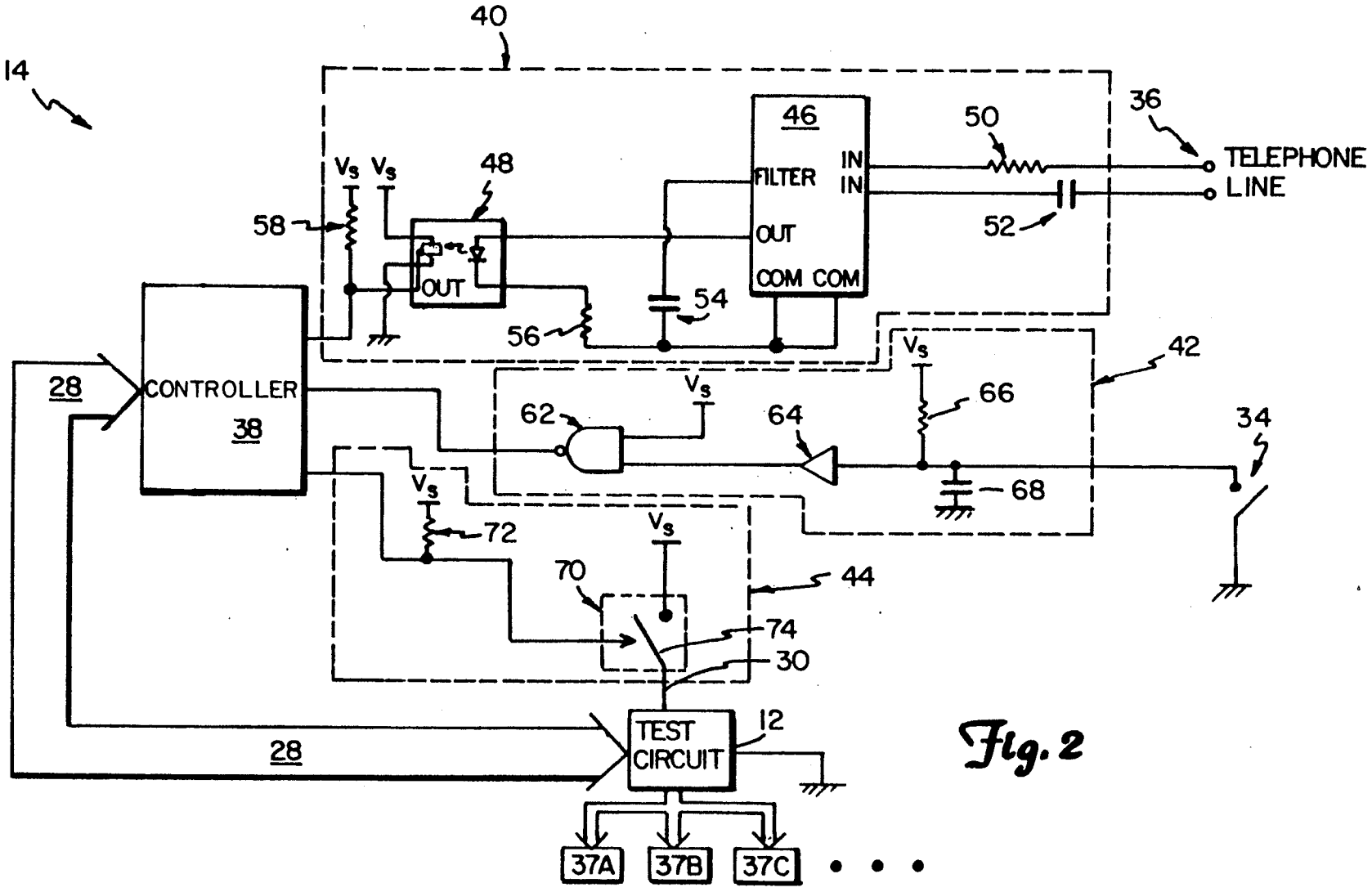
FIG. 2 is an electrical schematic diagram of a control circuit made in accordance with the present invention.

FIG. 2 shows a more detailed view of a portion of control circuit 14. Control circuit 14 includes controller 38 (which preferably comprises a microprocessor), telephone input circuit 40, sleep mode switch input circuit 42 and power control circuit 44.

Telephone input circuit 40 includes a ring detector 46 and an opto-isolator 48. Ring detector 46 couples to telephone line 36 through resistor 50 and capacitor 52. Resistor 50 is a 2.2K ohm resistor and capacitor 52 is 0.47 microfarads. A filter capacitor 54 connects to a filter input of ring detector 46. Capacitor 54 comprises a 10 microfarad capacitor. The output of ring detector 46 connected to an input of opto-isolator 48. Opto-isolator 48 includes a diode coupled to ground through resistor 56. Resistor 56 is a 680 ohm resistor. The output of opto-isolator 48 connects to controller 38 and to a power supply voltage source through a 12K ohm resistor 58.

Sleep mode switch input circuit 42 connects to sleep mode switch 34. Sleep mode switch input circuit 42 includes NAND gate 62, buffer amplifier 64, resistor 66 and capacitor 68. The input of buffer amplifier 64 connects to sleep mode switch 34. The input of buffer amplifier 64 also connects to a power supply voltage source through 47K ohm resistor 66 and to electrical ground through 0.1 microfarad capacitor 68. The output of buffer amplifier 64 connects to an input of NAND gate 62. Another input to NAND gate 62 connects to the power supply voltage sources. The output of NAND gate 62 connects to controller 38.

Power supply control circuit 44 includes a solid state relay 70 and resistor 72. A control input to solid state relay 70 is connected to controller 38 and to the power supply voltage source through 12K ohm resistor 72. Solid state relay 70 actuates switch 74. By actuating switch 74 in solid state relay 70, controller 38 connects test circuit 12 to the voltage power supply source.

In operation, the position of sleep mode switch 34 is detected by controller 38 through buffer amplifier 64 and NAND gate 62. The position of sleep mode switch 34 determine whether controller 38 enters a sleep mode. When controller 38 is in sleep mode, switch 72 of solid state relay 70 is open so that test circuit 12 is disconnected from the power supply voltage source. This saves energy and increases the lifespan of circuit components used in test circuit 12.

Controller 38 monitors telephone line 36. When ring detector 46 detects a ring signal on telephone line 36, an output signal is provided on the output of ring detector 46. The output from ring detector 46 energizes a light emitting diode in opto-isolator 48. Opto-isolator 48 is employed to prevent damage to controller 38 from large voltage spikes on telephone line 36. Opto-isolator 48 provides an output to controller 38 which indicates the presence of a ring signal on telephone line 36.

When controller 38 is in sleep mode (which is based upon the position of sleep mode switch 34) and controller 38 detects a ring signal provided by opto-isolator 48 which indicates the presence of a ring signal on telephone line 36, controller 38 actuates solid state relay 70. When solid state relay 70 is actuated by controller 38, switch 74 closes which connects test circuit 12 to the power supply voltage source and powers up test circuit 12. After being powered up by controller 38, test circuit 12 monitors telephone line 36 for instructions. Test circuit 12 may transmit data stored in storage system 26 over telephone line 36. Following the interrogation, control circuit 14 returns to sleep mode and disconnects test circuit 12 from the power supply.

The present invention provides a control circuit which controls automotive vehicle test equipment. Using the present invention, the test equipment can be powered down during periods of non-use. This saves energy and also extends life of the circuit components used in the automotive vehicle test equipment. A signal line, such as a telephone line, is monitored by the control circuit. Upon detection of a signal on the signal line (such as a ring signal), the control circuit powers up the test circuit. After the test circuit has been powered up, information stored in the test circuit can be dumped over a communications link to a remote, central location.

Although the present invention has been described with reference to preferred embodiments, workers skilled in the art will recognize that changes may be made in form and detail without departing from the spirit and scope of the invention.

What is claimed is:

1. An apparatus in an automotive vehicle test system comprising:

measurement means for measuring a parameter of the automotive vehicle;

storage means connected to the measurement means for storing measured parameters of the automotive vehicle;

input means for receiving an input and providing a sleep signal;

ring detector means for connecting to a telephone line and for providing a ring detected signal in response to a ring signal on the telephone line;

power controller means connected to the measurement means for connecting the measurement means to a power source in response to a connection signal; and controller means connected to the input means, ring detector means and power controller means for entering a sleep mode in a response to the sleep signal from the input means and providing a connection signal to the power controller means in response to receiving the ring detected signal from the ring detector means wherein power is supplied to the measuring means in response to a ring signal on the telephone line.

2. The apparatus of claim 1 wherein the test system comprises an automotive vehicle exhaust analyzer.

3. The apparatus of claim 1 wherein the power controller means comprises a solid state relay.

4. An apparatus in an automotive vehicle test system comprising:

a test circuit for testing a function of an automotive vehicle;

a control circuit coupled to the test circuit for controlling power to the test circuit comprising:

means for receiving a first input signal which comprises a sleep mode signal;

ring detector means connected to a telephone line for receiving a second input signal from a remote source;

switch means connected to a power source and to the test circuit for connecting the test circuit to the power source; and a controller coupled to the means for receiving a first input signal, the ring detector means for receiving a second input signal and the switch means, for monitoring the means for receiving a first input signal for the sleep mode signal and deactivating the switch means wherein the test circuit is disconnected from the power supply when the means for receiving a first input signal receives a first input signal and for monitoring the ring detector means and activating the switch means upon detection of a second input signal by the ring detector means for receiving a second input wherein the test circuit is connected to the power supply.

5. The apparatus of claim 4 wherein the test circuit comprises an automotive vehicle exhaust analyzer.

6. The apparatus of claim 4 wherein the switch means comprises a solid state relay.

7. An apparatus is an automotive vehicle test system comprising:

means for testing a function of an automotive vehicle;

means for receiving a first input signal;

ring detector means connected to a telephone line for receiving a second input signal from a remote source;

coupling means connected to a power source and the means for testing, for selectively coupling the means for testing to the power source upon receiving an activation signal and decoupling the means for testing from the power source when not receiving the activation signal; and controller means connected to the means for receiving a first input signal, the ring detector means for receiving a second input signal and the coupling means, for monitoring the ring detector means for receiving a second input signal and sending the activation signal to the coupling means upon receiving the second input signal wherein the means for testing is electrically coupled to the power source and for monitoring the first input means and inhibiting the activation signal wherein the means for testing is electrically decoupled from the power source.

8. The apparatus of claim 7 wherein the means for testing comprises an automotive vehicle exhaust analyzer.

9. The apparatus of claim 7 wherein the coupling means comprises a solid state relay.

* * * * *